United States Patent [19]

Kato et al.

[11] 4,401,078

[45] Aug. 30, 1983

[54] INTAKE THROTTLING DEVICE FOR DIESEL ENGINES

[75] Inventors: Kiyoshi Kato, Hirakata; Yasuo Kondo, Okazaki; Satosi Kuwakado, Aichi; Nobuhiko Kakeno, Toyota, all of Japan

[73] Assignees: Nippon Soken Inc., Nishio; Toyota Jidosha Kogyo Kabushiki Kaisha, Toyota, both of Japan

[21] Appl. No.: 386,762

[22] Filed: Jun. 9, 1982

[30] Foreign Application Priority Data

Jun. 12, 1981 [JP] Japan ..... 56-91147

[51] Int. Cl.[3] ..... F02D 9/00

[52] U.S. Cl. ..... 123/376; 123/378; 123/403

[58] Field of Search ..... 123/376, 378, 401, 403, 123/319, 324, 344

[56] References Cited

U.S. PATENT DOCUMENTS

| | | | |
|---|---|---|---|
| 2,356,679 | 8/1944 | Mallory | 123/376 |
| 3,548,798 | 12/1970 | Fleischer et al. | 123/379 |
| 3,744,471 | 7/1973 | Braun et al. | 123/376 |
| 4,060,063 | 11/1977 | Hirasawa | 123/376 |
| 4,106,469 | 8/1978 | Dey | 123/403 |

*Primary Examiner*—William A. Cuchlinski, Jr.

*Attorney, Agent, or Firm*—Cushman, Darby & Cushman

[57] ABSTRACT

An intake throttling device adapted to a Diesel engine includes an intake pipe for connection to an intake manifold of the engine, a throttle valve arranged within the intake pipe, and an actuator operatively connected to the throttle valve and arranged to be deactivated to fully open the throttle valve during normal operation of the engine, to be rendered in its first activated condition to adjust the opening angle of the throttle valve during idling operation of the engine, and to be rendered in its second activated condition to fully close the throttle valve when the engine is arrested or immediately before the engine is arrested.

3 Claims, 7 Drawing Figures

INTAKE THROTTLING DEVICE FOR DIESEL ENGINES

BACKGROUND OF THE INVENTION

The present invention relates to a control system for Diesel engines, and more particularly to an intake throttling device adapted to an intake manifold of the Diesel engine for reduction of engine vibration and noises.

In general, the level of vibration and noises in operation of a Diesel engine is higher than that in operation of an engine of the spark ignition type. For this reason, the operator and adjacent people are suffering from unpleasant noises particularly in idling operation of the Diesel engine. Such vibration and noises occur at a high level when the Diesel engine is arrested. For the purpose of decreasing the level of the vibration and noises, it has been proposed to throttle the intake air during idling operation of the engine and to fully throttle the intake air when the engine is arrested. It has, however, been observed that if the intake air is throttled in operation of the engine at a high speed under a high loaded condition, there will occur drop of the engine power and worse of the emission color. If the intake air is fully throttled during the idling operation of the engine, there will occur worse of combustion in the engine, resulting in difficulty of the engine operation. It is, therefore, required to systematically solve the above-described problems in application of an intake throttling device to the intake manifold of the Diesel engine.

SUMMARY OF THE INVENTION

A primary object of the present invention is directed to provision of an intake throttling device which is capable of properly adjusting the throttle degree of intake air in accordance with operating conditions of the Diesel engine to effectively reduce vibration and noises of the engine without causing drop of the engine power and worse of emission color.

According to the present invention there is provided an intake throttling device adapted to a Diesel engine which comprises an intake pipe for connection to an intake manifold of the engine, a throttle valve arranged within the intake pipe and fixed to a valve shaft rotatably supported from the intake pipe to rotate in response to the rotary movement of the valve shaft, an actuator operatively connected to the valve shaft to fully open the throttle valve in its deactivated condition, to adjust the opening angle of the throttle valve suitable for operation of the engine under a low loaded condition in its first activated condition, and to fully close the throttle valve in its second activated condition, and control means for mantaining the actuator in its deactivated condition during normal operation of the engine, for rendering the actuator in its first activated condition during operation of the engine under the low loaded condition and for rendering the actuator in its second activated condition when the engine is arrested or immediately before the engine is arrested.

BRIEF DESCRIPTION OF THE DRAWINGS

The above and other objects, features and attendant advantages of the present invention will be more fully appreciated as the same becomes better understood from the following detailed description in connection with the accompanying drawings in which.

DETAILED DESCRIPTION OF THE PREFERRED EMBODIMENT

Figure 1:
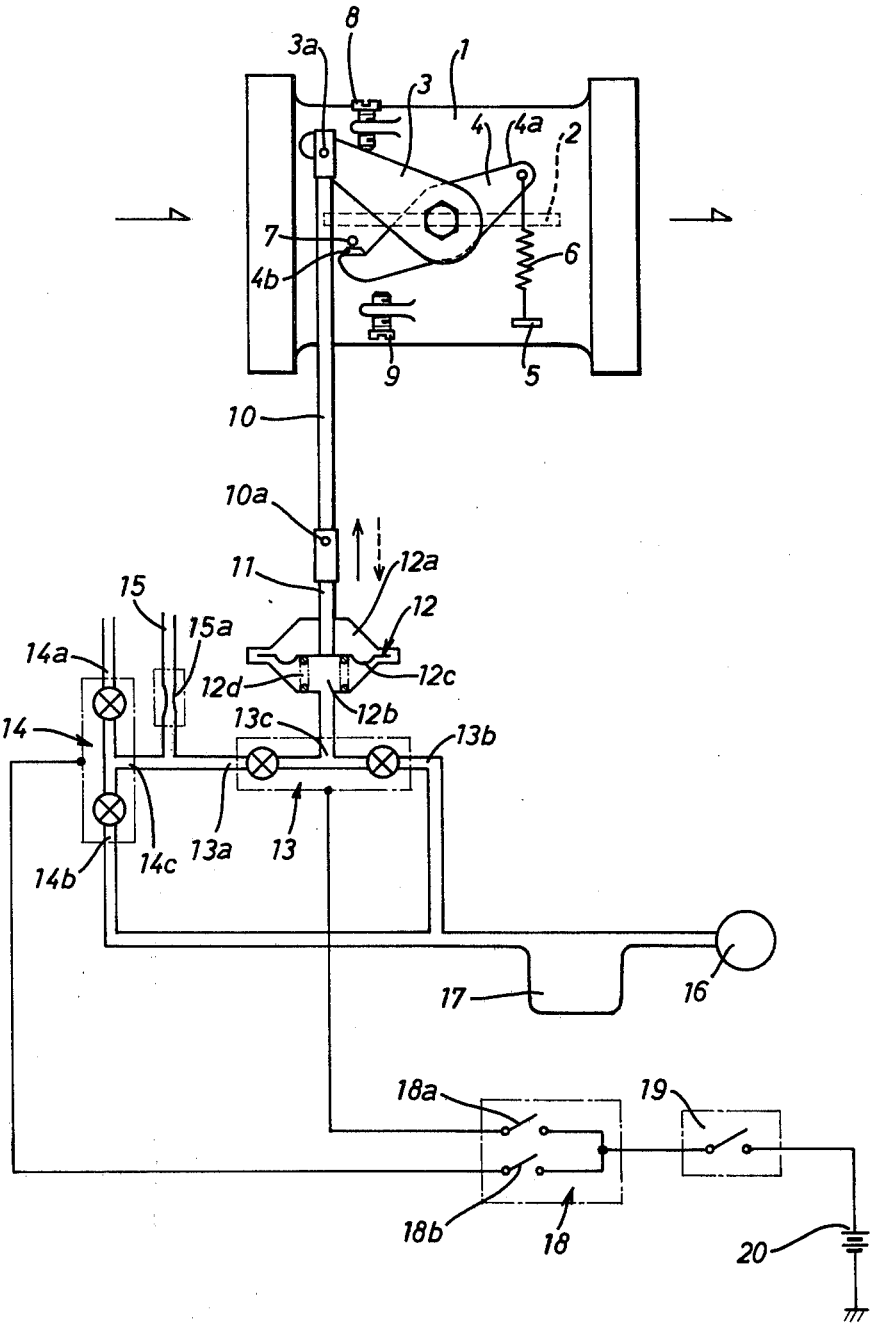
FIG. 1 is a diagrammatic view showing an intake throttling device in accordance with the present invention.
Figure 3:
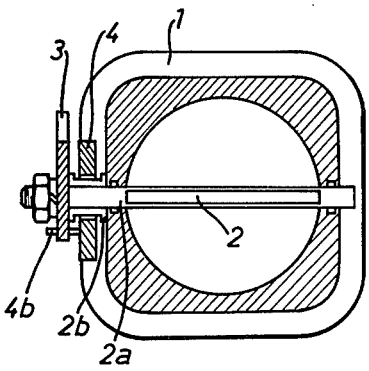
FIG. 3 is a cross-sectional view taken along III—III line in FIG. 2.

Referring now to the drawings, particularly in FIG. 1 there is illustrated an intake throttling device in accordance with the present invention which includes an intake pipe 1 in connection to the intake manifold of a Diesel engine (not shown). The intake pipe 1 is provided therein with a throttle valve 2 which is fixed to a valve shaft 2*a* rotatably supported from intake pipe 1 as can be well seen in FIG. 3. An adjusting lever 3 is fixed to the outer end of valve shaft 2*a*, and a stopper lever 4 is rotatably mounted on valve shaft 2*a*. The adjusting lever 3 is loaded by a return spring (not shown) in such a way to open the throttle valve 2. The fully open position of throttle valve 2 is determined by abutment of the adjusting lever 3 against a stopper bolt 8 threaded into a flange portion of intake pipe 1. The stopper lever 4 is loaded by a return spring 6 clockwisely and abuts against a stopper pin 7 fixed to intake pipe 1. The return spring 6 is engaged at its one end with the right end 4*a* of lever 4 and at its other end with a projection of intake pipe 1. A lower stopper bolt 9 is threaded into a lower flange portion of intake pipe 1 to restrict rotary movement of lever 4 in the counterclockwise direction. In the above arrangement, the spring load on stopper lever 4 is determined to be equal to or larger than that on the adjusting lever 3.

The adjusting lever 3 is connected at its movable end to an output shaft 11 of a vacuum actuator 12 by means of a connecting linkage 10 which is connected at its one end to the movable end 3*a* of lever 3 and at its other end 10*a* to the output shaft 11. The vacuum actuator 12 includes a diaphragm piston 12*c* connected to the output shaft 11 to be actuated by difference in pressure between first and second chambers 12*a* and 12*b*. The diaphragm piston 12*c* is loaded by a return spring 12*d* in the second chamber 12*b* to normally open the throttle valve 2. The first chamber 12*a* is in open communication with the atmosphere, while the second chamber 12*b* is connected to a vacuum source 16 by way of a three port connection valve of the solenoid type 13 and a vacuum tank 17. The vacuum source 16 is in the form of a vacuum pump driven by the Diesel engine.

The three port connection valve 13 has three ports 13*a*, 13*b*, 13*c* respectively in connection to a three port connection valve 14, the vacuum tank 17 and the second chamber 12*b* of actuator 12. The valve 13 acts to provide a communication between the ports 13*a* and 13*c* in its deenergized condition and to provide a communication between the ports 13*b* and 13*c* in its energized condition. The three port connection valve 14 is of the solenoid type and has three ports 14*a*, 14*b*, 14*c* respectively in connection to the atmosphere, the vacuum tank 17 and the first port 13*a* of valve 13. The valve 14 acts to provide a communication between the ports 14*a* and 14*c* in its deenergized condition and to provide a communication between the ports 14*b* and 14*c* in its energized condition. Provided between the ports 13*a* and 14*c* is a passage 15 which is in open communication with the atmosphere through a throttling portion 15*a*.

An electric current supply to the respective solenoids of valves 13 and 14 is under the control of a key switch 18 and an accelerator switch 19. The key switch 18 has first and second movable contacts 18*a*, 18*b* which are interlocked with a manual key (not shown). The first movable contact 18*a* is connected to the solenoid of valve 13 and arranged to be closed when the key is moved to its ACC position and to be opened when the key is in its other positions. The second movable contact 18*b* is connected to the solenoid of valve 14 and arranged to be closed when the key is moved to its ON position and to be opened when the key is in its other positions. The accelerator switch 19 is connected in series with the key switch 18 and an electric power source 20 in the form of a vehicle battery, which is arranged to be closed when an accelerator pedal of the vehicle is released and to be opened when the accelerator pedal is slightly depressed.

Figure 2:
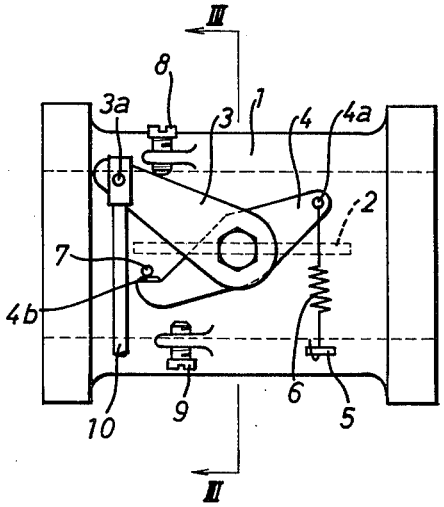
FIG. 2 shows the same view as FIG. 1, illustrating the fully open position of the throttle valve.

In operation, when the key is moved to its ST position to start the engine, both the movable contacts 18*a*, 18*b* of key switch 18 are in their open positions to maintain deenergization of the valves 13 and 14. At this stage, the solenoid valve 13 acts to communicate the third port 13*c* with the first port 13*a*, while the solenoid valve 14 acts to communicate the first port 14*a* with the third port 14*c*. This results in open communication of the second chamber 12*b* of actuator 12 with the atmospheric pressure through ports 13*c*, 13*a*, 14*c* and 14*a*. Thus, the actuator 12 is in its inoperative condition, and the connecting linkage 10 is loaded by biasing forces acting on the diaphragm piston 12*c* and the adjusting lever 3 in the direction shown by a solid arrow such that the adjusting lever 3 is in abutment against the stopper bolt 8 to fully open the throttle valve 2 as shown in FIG. 2. Under this initial condition, the stopper lever 4 is maintained in abutment with the stopper pin 7 under loading of return spring 6.

Figure 4:
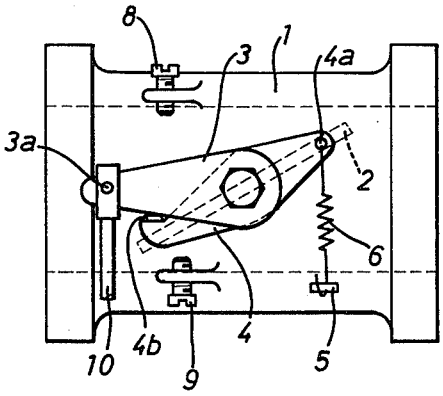
FIG. 4 shows the same view as FIG. 1, illustrating an adjusted position of the throttle valve.

When the accelerator pedal is released in idling operation of the engine, the accelerator switch 19 is closed and the second movable contact 18*b* is closed due to ON position of the key to energize the solenoid of valve 14. On the other hand, the first movable contact 18*a* of key switch 18 is maintained in its open position to remain the solenoid of valve 13 in its deenergized condition. Under such condition, the solenoid valve 14 acts to communicate the second port 14*b* with the third port 14*c*, while the solenoid valve 13 is still conditioned to remain the communication between the first and third ports 13*a* and 13*c*. This results in open communication of the second chamber 12*b* of actuator 12 with the vacuum tank 17. Then, the second chamber 12*b* of actuator 12 is applied with the vacuum pressure from tank 17 to activate the actuator 12. The pressure in the second chamber 12*b* is, however, controlled at a level less than the vacuum pressure because of introduction of the atmospheric pressure across the throttling portion 15*a* of passage 15. Thus, the diaphragm piston 12*c* of actuator 12 is moved by difference in pressure between the first and second chambers 12*a*, 12*b* against the biasing forces acting thereon, and in turn, the connecting linkage 10 is moved in the direction shown by a dotted arrow to rotate the adjusting lever 3 counterclockwisely. In this instance, the counterclockwise rotation of lever 3 is restricted by abutment against a lateral lug 4*b* of stopper lever 4 because the spring load on lever 4 is determined to be larger than the rotational force applied to the adjusting lever 3 from actuator 12. As a result of the counterclockwise rotation of adjusting lever 3, the opening angle of throttle valve 2 is adjusted and maintained in its adjusted position as shown in FIG. 4 to properly throttle the intake air routed into the engine.

When the accelerator pedal is slightly depressed during idling operation of the engine to open the accelerator switch 19, both the solenoids of valves 13 and 14 are deenergized to make the port connections of valves 13 and 14 as same as those in starting operation of the engine. This results in open communication of the second chamber 12*b* of actuator 12 with the atmospheric pressure through ports 13*c*, 13*a*, 14*c* and 14*a*. Thus, the actuator 12 is deactivated to rotate the adjusting lever 3 clockwisely under loading of the return springs so as to fully open the throttle valve 2 as shown in FIG. 2.

Figure 5:
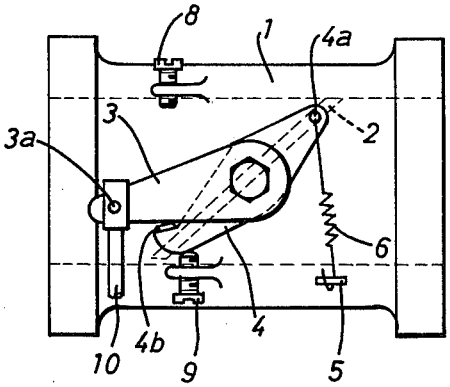
FIG. 5 shows the same view as FIG. 1, illustrating the fully closed position of the throttle valve.

When the key is returned to its ACC position from its ON position to stop the engine, the first movable contact 18*a* of key switch 18 is closed, the second movable contact 18*b* of key switch 18 is opened, and the accelerator switch 19 is maintained in its closed position. Then, the solenoid of valve 13 is energized to communicate the port 13*c* with the port 13*b* and to block the communication between the ports 13*c* and 13*a*, while the solenoid of valve 14 is maintained in its deenergized condition to communicate the port 14*a* with the port 14*c*. Thus, the second chamber 12*b* of actuator 12 is directly applied with the vacuum pressure from tank 17 so that the diaphragm piston 12*c* is moved by difference in pressure between the first and second chambers 12*a*, 12*b* to rotate the adjusting lever 3 counterclockwisely through connecting linkage 10. In this instance, the pressure in the second chamber 12*b* of actuator 12 becomes the same as the vacuum pressure because of no introduction of the atmospheric pressure from passage 15. For this reason, the rotational force acting on the adjusting lever 3 overcomes the biasing force of return spring 6 in abutment of the adjusting lever 3 against the lateral lug 4*b* of lever 4. As a result, the adjusting lever 3 further rotates together with the stopper lever 4 counterclockwisely to fully close the throttle valve 2 as shown in FIG. 5. In this operation, the counterclockwise rotation of lever 3 is restricted by abutment of the stopper lever 4 against the stopper bolt 9. When the key is returned to its OFF position, all the switches 18 and 19 are opened to deenergize both the solenoids of valves 13 and 14, and the actuator 12 is deactivated to return the throttle valve 2 to its fully open position.

Figure 6:
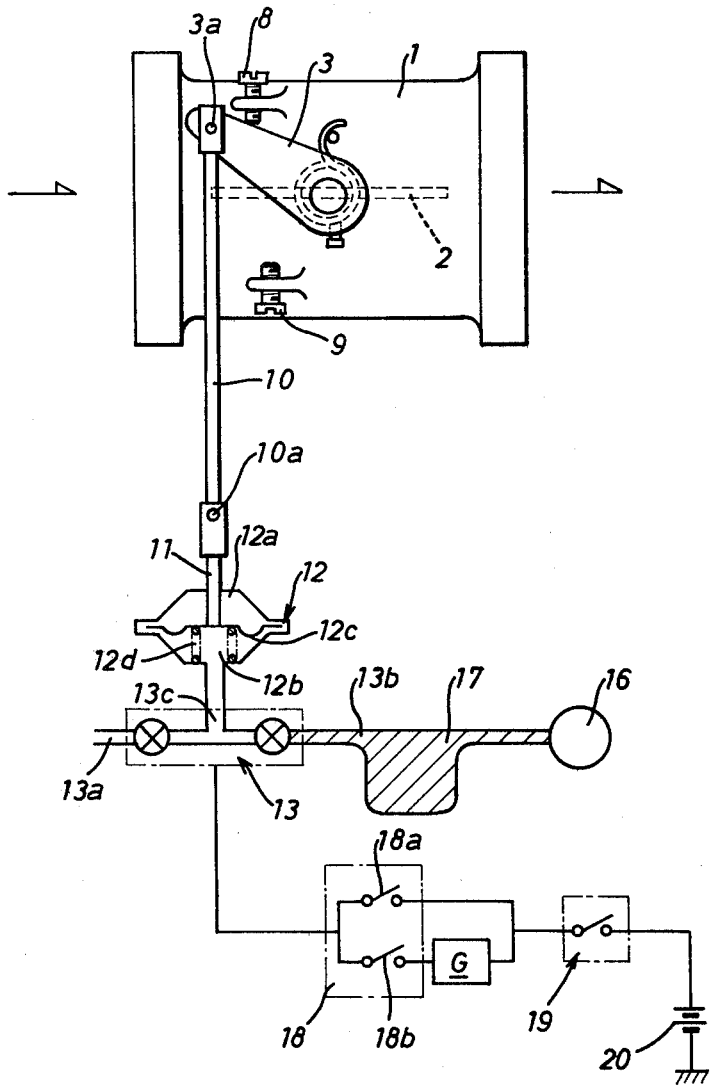
FIG. 6 is a diagrammatic view showing a modification of the intake throttling device of FIG. 1.
Figure 7:
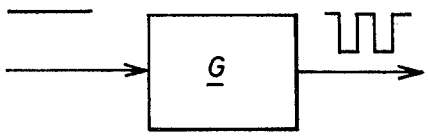
FIG. 7 is a diagram of the oscillator circuit.

In FIG. 6 there is illustrated a modification of the above-described embodiment in which the adjusting lever 3 and the solenoid valve 13 are remained without provision of the stopper lever 4 and the solenoid valve 14. In this modification, the rate of electric current supply to the solenoid of valve 13 is controlled to adjust the application of vacuum pressure to the second chamber 12*b* of actuator 12 at least at two stages. For this control, an oscillator circuit G is connected in series with the second movable contact 18*b* of key switch 18 to continuously generates ON-OFF signals when the accelerator switch 19 and the second movable contact 18*b* are closed. In operation of the modification, when the key is in its ACC position after the accelerator switch 19 is closed, the first movable contact 18*a* of key switch 18 is closed to supply the direct current to the solenoid of valve 13 from the electric power source 20. This results in fully open communication between the ports 13*b* and 13*c* to apply the vacuum pressure to the second chamber 12*b* of actuator 12 from tank 17 at the rate of 100%. When the key is in its ON position after the accelerator switch 19 is closed, the second movable contact 18*b* of key switch 18 is closed to activate the oscillator circuit G. Then, the solenoid of valve 13 is intermittently energized in response to a series of ON-OFF signals from oscillator circuit G so that the port 13*c* is alternately communicated with the air port 13*a* and the vacuum port 13*b*. As a result, the second chamber of actuator 12 is alternately applied with the atmospheric pressure and the vacuum pressure to control the pressure in the second chamber 12*b* of actuator 12 at the rate of ON-OFF signals. The other construction and operation of the modification are substantially the same as those of the above-described embodiment.

In the actual practices of the present invention, the accelerator switch 19 may be replaced with a switch arranged to discriminate whether or not the engine is in its idling operation. For this reason, the accelerator switch 19 may be also replaced with a switch arranged to be closed in response to a speed signal issued from a vehicle speed sensor when the vehicle speed is below a predetermined value or to be closed in response to a speed signal issued from an engine rotational speed sensor when the rotational speed of the engine is below a predetermined value. In the case that when the second movable contact 18*b* of key switch 18 is closed, fuel-cut of a fuel injection pump is retarded by provision of a delay circuit, it is able to fully close the throttle valve 2 immediately before the engine stop so as to effectively decrease the level of engine vibration.

Having now fully set forth both structure and operation of preferred embodiments of the concept underlying the present invention, various other embodiments as well as certain variations and modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An intake throttling device adapted to a Diesel engine, comprising:

an intake pipe for connection to an intake manifold of said engine;

a throttle valve arranged within said intake pipe and fixed to a valve shaft rotatably supported from said intake pipe to rotate in response to the rotational movement of said valve shaft;

an actuator operatively connected to said valve shaft to fully open said throttle valve in its deactivated condition, to adjust the opening angle of said throttle valve suitable for operation of said engine under a low loaded condition in its first activated condition, and to fully close said throttle valve in its second activated condition; and control means for maintaining said actuator in its deactivated condition during normal operation of said engine, for rendering said actuator in its first activated condition during operation of said engine under the low loaded condition and for rendering said actuator in its second activated condition when said engine is arrested or immediately before said engine is arrested.

2. An intake throttling device as claimed in claim 1, wherein an adjusting lever is fixed to one end of said valve shaft and arranged to be moved to a first position in which said throttle valve is fully opened, to a second position in which the opening angle of said throttle valve is adjusted to a value suitable for idling operation of said engine, and to a third position in which said throttle valve is fully closed, and said actuator is in the form of a vacuum actuator including a spring loaded diaphragm piston operatively connected to said adjusting lever to be activated by difference in pressure between first and second chambers facing to both faces of said piston, said first chamber being in open communication with the atmosphere, and said second chamber being arranged to be connected to a vacuum source; and wherein said control means is arranged to control the supply of vacuum to said second chamber of said actuator from said vacuum source in such a manner that said diaphragm piston is deactivated during the normal operation of said engine to maintain said adjusting lever in its first position, activated in the idling operation of said engine to move said adjusting lever to its second position and activated when said engine is arrested to move said adjusting lever to its third position.

3. An intake throttling device as claimed in claim 2, wherein said control means includes a communication passage member connecting said second chamber of said actuator to said vacuum source, an electrically operated switch-over valve disposed within said communication passage member to connect said second chamber of said actuator to the atmospheric pressure in its deenergized condition and to connect said second chamber of said actuator to said vacuum source in its energized condition, an electric control circuit for controlling the supply of electric current to said valve in such a way to deenergize said valve during the normal operation of said engine and to energize said valve during the idling operation of said engine and when said engine is arrested, and means for controlling the supply of vacuum to said second chamber of said actuator during energization of said valve in the idling operation of said engine to move said adjusting lever to its second position.

* * * * *